US007234988B2

(12) United States Patent
Patton

(10) Patent No.: US 7,234,988 B2
(45) Date of Patent: Jun. 26, 2007

(54) ENHANCED EXPRESSIVE FEATURE MECHANISM FOR ANIMATED CHARACTERS AND DEVICES

(75) Inventor: Brian L. Patton, Ewing, NJ (US)

(73) Assignee: Thin Air Creation, LLC, Ewing, NJ (US)

( * ) Notice: Subject to any disclaimer, the term of this patent is extended or adjusted under 35 U.S.C. 154(b) by 224 days.

(21) Appl. No.: 10/975,917

(22) Filed: Oct. 28, 2004

(65) Prior Publication Data

US 2005/0059319 A1 Mar. 17, 2005

(51) Int. Cl.
*A63H 13/02* (2006.01)

(52) U.S. Cl. ..... 446/337; 446/395

(58) Field of Classification Search ..... 446/190, 446/301, 300, 297, 175, 298, 330, 337, 340, 446/395, 352, 353, 358, 391
See application file for complete search history.

(56) References Cited

U.S. PATENT DOCUMENTS 2,250,916 A 7/1941 Magruder
3,828,469 A 8/1974 Giroud
3,841,020 A 10/1974 Ryan et al.
4,177,589 A 12/1979 Villa
4,294,033 A 10/1981 Terzian
4,805,328 A 2/1989 Mirahem
4,808,142 A 2/1989 Berliner
5,376,040 A * 12/1994 Hickman et al. ..... 446/329
6,352,464 B1 3/2002 Madland et al.
6,386,942 B1 * 5/2002 Tang ..... 446/301
6,503,123 B2 * 1/2003 Chung ..... 446/330
6,544,098 B1 4/2003 Hampton et al.
7,021,988 B2 * 4/2006 Patton ..... 446/337

* cited by examiner

*Primary Examiner*—Kien Nguyen
(74) *Attorney, Agent, or Firm*—Synnestvedt Lechner & Woodbridge LLP

(57) ABSTRACT

A mechanism effectively mimics human facial expressions for use in animated characters. On the front surface of the mechanism, four gears, meshed in pairs, provide rotational surfaces for a series of cranks and pins. As the gears rotate, the cranks and pins engage a loop of elastomeric material. As pin distance from each other, the loop stretches. As pins approach each other, the loop contracts. Other pins located on the cranks or gears cause an inflection or deflection of the loop as the gears rotate. The resulting stretch or bending of the loop more accurately and efficiently mimics facial expressions.

38 Claims, 10 Drawing Sheets

ENHANCED EXPRESSIVE FEATURE MECHANISM FOR ANIMATED CHARACTERS AND DEVICES

CROSS REFERENCE TO RELATED APPLICATIONS

This application claims the priority of U.S. Provisional Application Ser. No. 60/381,722 entitled "Expressive Feature Mechanism for Animated Characters and Devices" filed on May 17, 2002 and application PCT/US03/15120 filed on May 14, 2003, the entire contents and substance of which are hereby incorporated in total by reference.

BACKGROUND OF THE INVENTION

1. Field of the Invention

The present invention relates to a mechanical apparatus used to cause various expressions on the face of an animated character.

2. Description of Related Art

This invention pertains to an expressive feature mechanism used in an animated character. The goal of this invention is to achieve a full range of human-like and recognizable facial expressions. This goal has been addressed by others and has often led to the development of devices used in animated characters that have mouths, which open and close to mimic speaking or sucking. An example of such work would be U.S. Pat. No. 4,808,142 by Berliner, which has a motor driven mouth actuator to move the mouth between open and closed positions.

U.S. Pat. No 2,250,916 by Magruder uses electromagnetic coils to animate the upper and lower lip in synchrony to sound.

U.S. Pat. No. 3,841,020 by Ryan employs a complex set of levers and actuators that allow a range of facial expressions related to the motion of a doll's arms.

U.S. Pat. No. 3,828,469 by Giroud describes a mechanism having two operating rods for moving upper and lower lips.

More recently issued patents describe techniques that allow for a greater control of lip motion. For example, U.S. Pat. No. 6,352,464 by Madland et al. describes a mechanism for an animated character. The Madland Patent describes a facial control system comprising two lip chains embedded behind two lips. The lip chains are attached at either end as well as at a center portion. By positioning the movable center portion relative to the moveable ends various facial expressions can be achieved, however, the described mechanism does not allow for stretching of the lips as it occurs on human and animal faces.

Other methods such as the one described in U.S. Pat. No. 4,177,589 by Villa include a pneumatic mechanism to open and close the mouth. That method allows for a rounding of the lips but does not allow for a full range of expression such as a frown or broad smile.

Mechanisms such as U.S. Pat. No. 6,544,098 by Hampton are capable of some recognizable expressions but only with the addition of other actions such as drooping ears or closing eyes.

Other devices of possible relevance are described in the following U.S. Pat. Nos. 4,294,033; 4,805,328; 5,376,040; 6,386,942 and 6,503,123.

The current invention comprises an improved means to make animated characters with complex facial expressions in a minimal component, minimal cost, highly efficient mechanism. This mechanism improves upon the mechanism described in the previously submitted U.S. Provisional Application Ser. No. 60/381,722 and PCT/US03/15120 filed May 14, 2003 by allowing stretch of the lip member beyond the radius of the primary drive wheels. This improved design creates a more recognizable expression with the added benefit of a more compact design per breadth of smile.

SUMMARY OF INVENTION

Briefly described, the invention comprises of a pair of wheels or meshed gears used to generate human-like expressions. On each wheel or gear there is a lever driven attachment point and a device for inflecting or deflecting an elastomeric or flexible material or device. The primary goal of the wheels or gears is to directly stretch or allow for contraction of the elastomeric or flexible material or device attached to a point along a radius, or to drive a series of levers to stretch or allow for contraction of the elastomeric or flexible material. Meshing of the gears allows for a reduction of drive sources while maintaining bilateral symmetry of motion. Independent wheels allow for asymmetric motion. In a meshed gear mechanism, one gear and its attachment point mirror the other in the pair. If one gear in the pair turns clockwise, the other gear in the pair turns counterclockwise. Since attachment points mirror each other on each gear of a pair, rotation of the pair would either increase or decrease the distance between each attachment point. An elastomeric or flexible material or device encircling the attachment points stretches or contracts as the gears turn. The inflection/deflection devices offer an increase in the recognition of an exaggerated expression produced by the bending of the elastomeric or flexible material or device.

The elastomeric or flexible material or device can comprise a variety of conformations, ranging from a continuous band to a molded mask hiding and yet attached to the entire mechanism. The transmission of movement from the gears or levers to the elastomeric or flexible material or device may also occur via indirect coupling such as magnetism.

The invention advantageously provides a moving lip mechanism for animated characters or devices that is efficient in its design and construction. The device is capable of producing a range of motions in a range of speeds able to simulate a variety of expressions and mouth movements. With the synchronization of sound the device can simulate smooth, realistic vocalization.

This invention will be described further with reference to the following drawings.

DETAILED DESCRIPTION OF THE PREFERRED EMBODIMENT

Figure 1A:
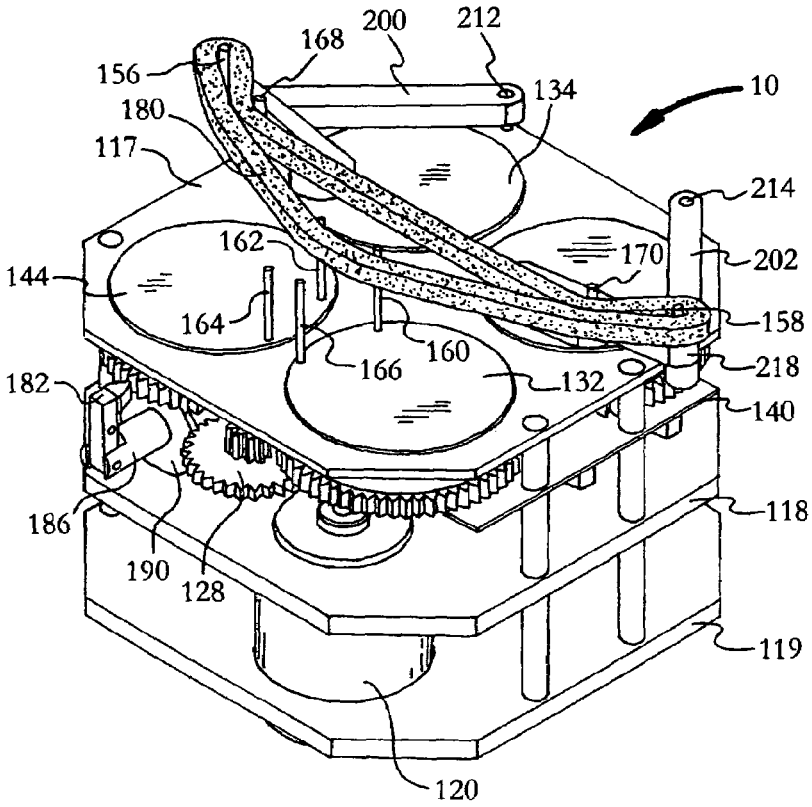
FIG. 1*a* is an isometric view of the preferred embodiment showing a pair of dual gear, single drive mechanisms using motors with non-integrated encoding with the elastomeric material in place around attachment points on each of the gears and gear driven link mechanisms.

During the course of this description, like numbers will be used to identify like elements according to the different views that illustrates the invention.

Referring to FIGS. 1*a*-1*e*, the mechanism 10, according to the preferred embodiment, comprises a lower motor support platform 119, an upper motor support platform 118 and a gear support platform 117. The motor support platform secures two motors 120 and 122, also referred to as a drive means, which in turn have small motor drive gears 124 and 126 respectively attached to their perspective drive shafts. Gears 124 and 126 mesh with reduction gears 128 and 130 respectively. The reduced diameters of reduction gears 128 and 130 mesh with primary expression driving gears 132 and 134 respectively. Expression diving gears are also referred to as rotatable means. Positional sensing of the primary expression driving gear 132 is achieved by variable resistance or positional contacts on the control board 140 in a manner known to those of ordinary skills in the art. It is understood that other commercial means of encoding of position would be equally effective in positional sensing. Magnetic encoding, transmission slots counting, and reflective encoding are examples of other common methods of rotational encoding. Primary expression driving gears 132 and 134 in turn mesh with secondary expression driving gears 144 and 146 respectively. Expression driving gears 132 and 134 have one drive pin each affixed to a point on their surface. Expression driving gears 144 and 146 have two drive pins each affixed to points in relation to the radius of each respective expression driving gear. Expression driving gears 144 and 146 drive pins are at a fixed degree apart from one another. In the case of primary expression driving gear 132, it has attachment drive pin 160 and inflection-deflection drive pin 166 affixed. In the case of primary expression driving gear 144, it has attachment drive pin 162 and inflection-deflection drive pin 164 affixed. In the case of primary expression driving gear 134, it has a link drive pin 204 affixed. In the case of primary expression driving gear 146, it has a link drive pin 206 affixed. Rotation of gears 134 and 146 causes link drive pins 204 and 206 to push or pull inflection-deflection links 216 and 218. The pushing or pulling of inflection-deflection links 216 and 218 in turn causes the pivoting of links 200 and 202 on fulcrums 212 and 214 respectively. Links 200 and 216 together form the first crank means. Links 202 and 218 together form the second crank means Affixed to links 200 and 204 are attachment points 156 and 158 which also serve as fulcrum points for inflection links 216 and 218 respectively. Affixed to links 216 and 218 are inflection-deflection points 168 and 170 respectively. Fitted around the four attachment points is elastomeric material 180, also referred to as an elastic loop means. To prevent the return rotation of the primary and secondary expression driving gears, gearlocks 182 and 184 fits into the teeth of secondary expression driving gears 144 and 146 respectively. Gearlock 182 is allowed to release secondary expression driving gear 144 by having shaft 186 pulled by solenoid 190 and pivoted on its axis. Gearlock 184 is allowed to release secondary expression driving gear 146 by having shaft 188 pulled by solenoid 192 and pivoted on its axis.

FIG. 1*a* illustrates an isometric view of the preferred embodiment of the mechanism 10. In this view, the attachment points 156, 158, 160, and 162 for holding the elastomeric material 180 represent lips, in a smiling expression. In the preferred embodiment, power to the motors 120 and 122 (see also FIG. 1*b*) is not applied once the desired position is sensed by control board 140. Instead, position is maintained against the pull of elastomeric material 180 by securing the drive gears 144 and 146 against rotation with the gearlocks 182 and 184 (see also FIG. 1*b*). Rotation of the motors and change in expression of 10 as represented by the position of 180 is allowed by the activation of solenoids 190 and 192, see also FIG. 1*b*, and the pull back of respective gearlocks 182 and 184.

Figure 1B:
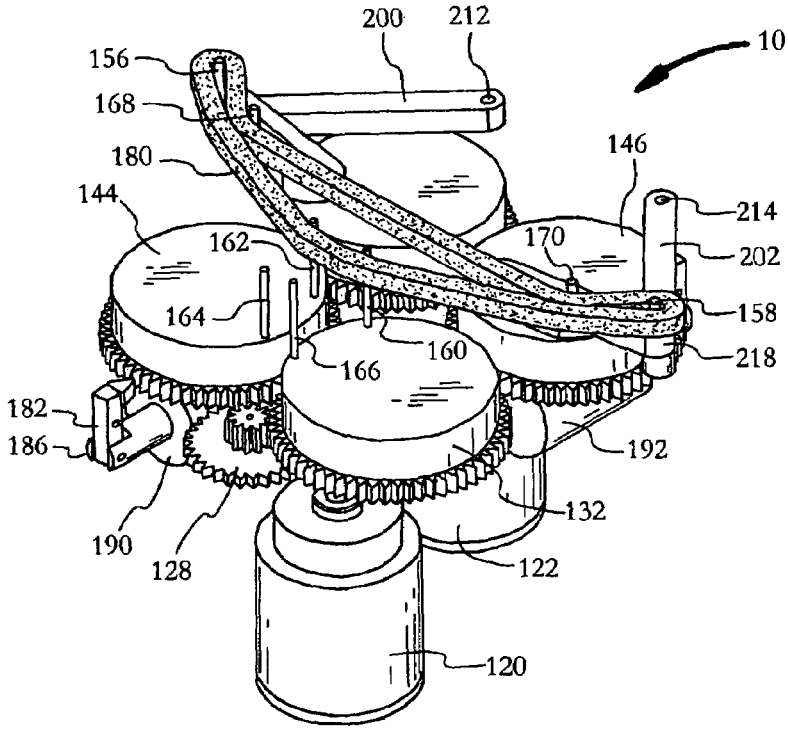
FIG. 1*b* is an isometric view with the support platform removed from the preferred embodiment showing a pair of dual gear, single drive mechanisms and employing motors with non-integrated encoding with the elastomeric material in place around attachment points on each of the gears and gear driven link mechanisms.

FIG. 1*b* shows the same isometric view of the preferred embodiment as FIG. 1*a* but with the removal of support platforms 117,118,119 and circuit board 140 for clarity, see also FIG. 1*a*.

Figure 1C:
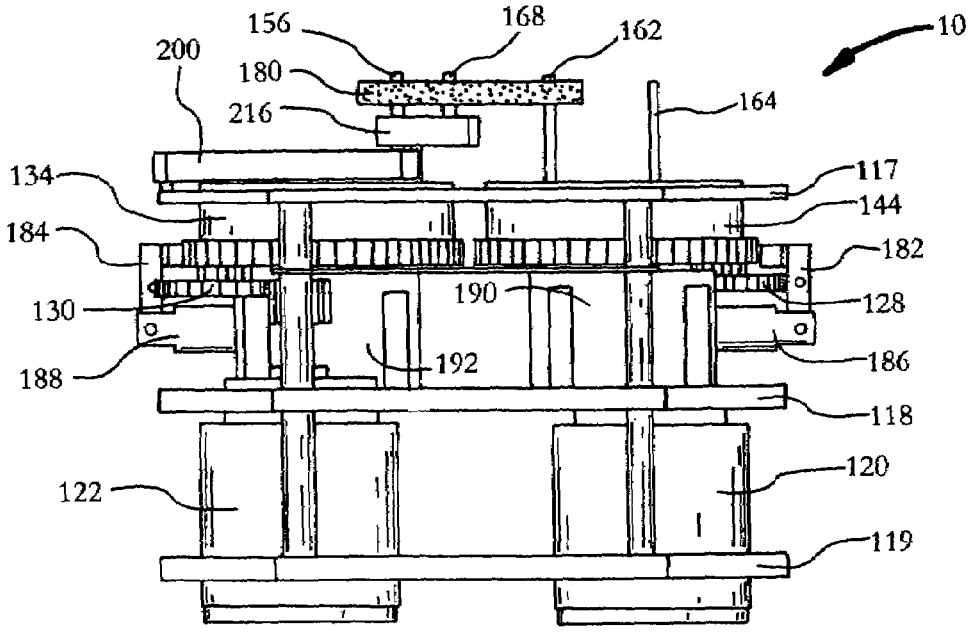
FIGS. 1*c*-1*e* are additional orthogonal views of the preferred embodiment showing a pair of dual gear, single drive mechanisms and employing motors with non-integrated encoding with the elastomeric material in place around attachment points on each of the gears and gear driven link mechanisms.
Figure 1D:
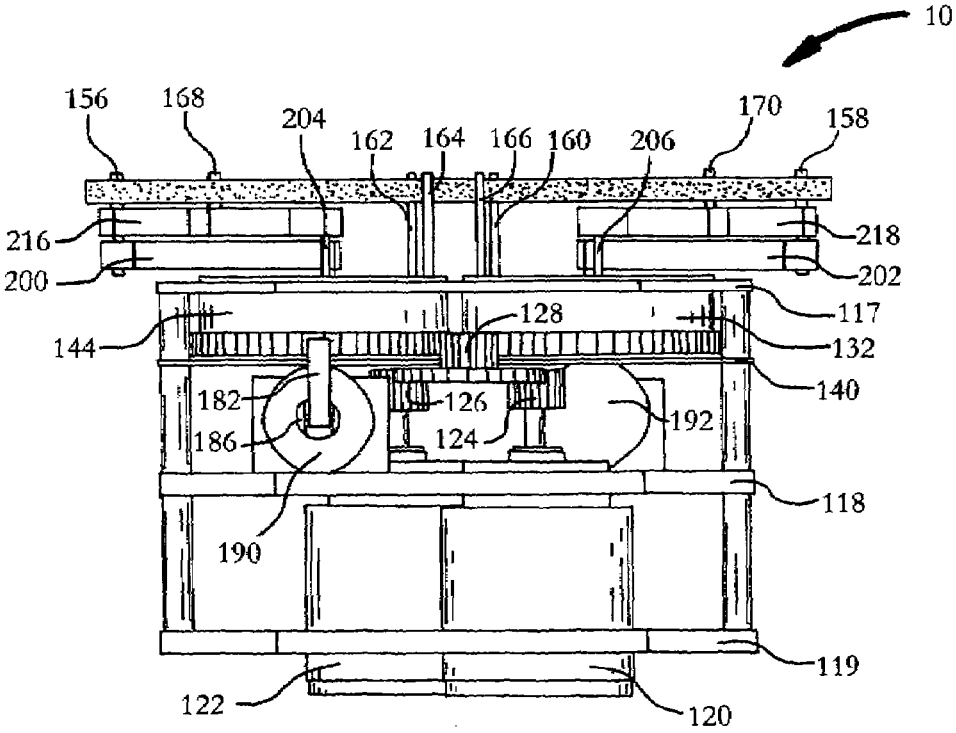

FIG. 1*c* and FIG. 1*d* also illustrate the preferred embodiment and show a right side and back view respectively of the mechanism 10. These views give clear perspectives of the relative positions of reduction gears 128 and 130 to their meshed small motor drive gears 124 and 126 and primary expression driving gears 132 and 134.

Figure 1E:
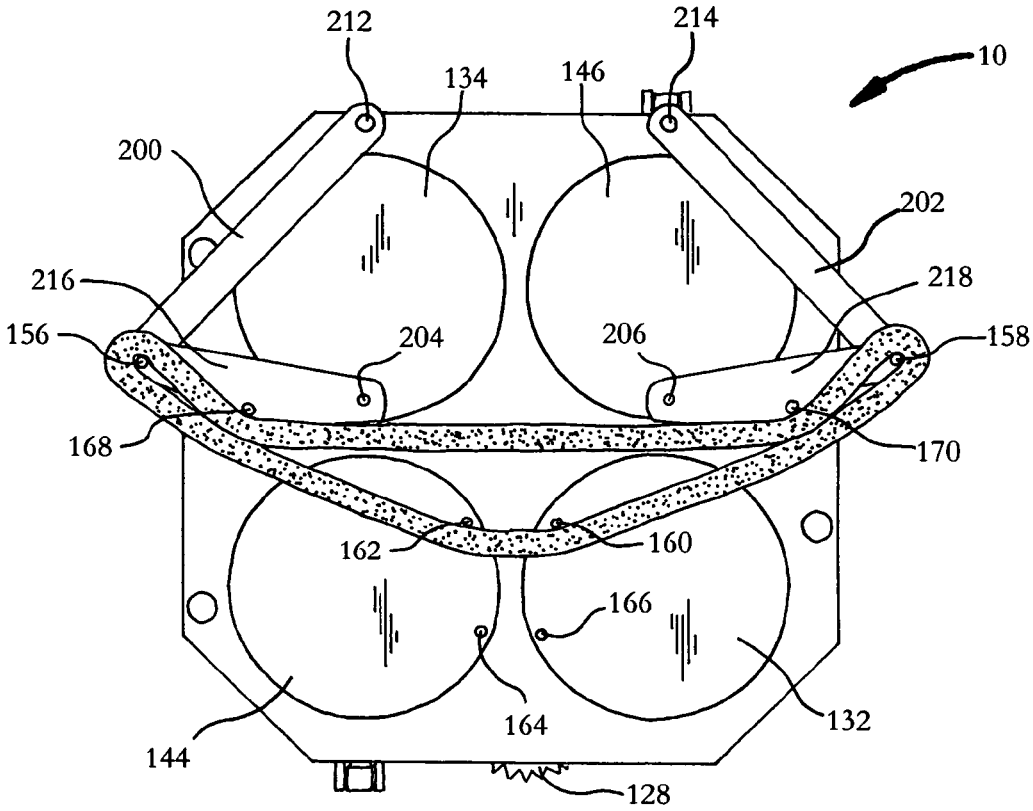

FIG. 1*e* also describes the preferred embodiment and illustrates a top plan view of the mechanism 10. This view would be the side that faces forward and represents the mouth of an animated character or design.

Figure 2:
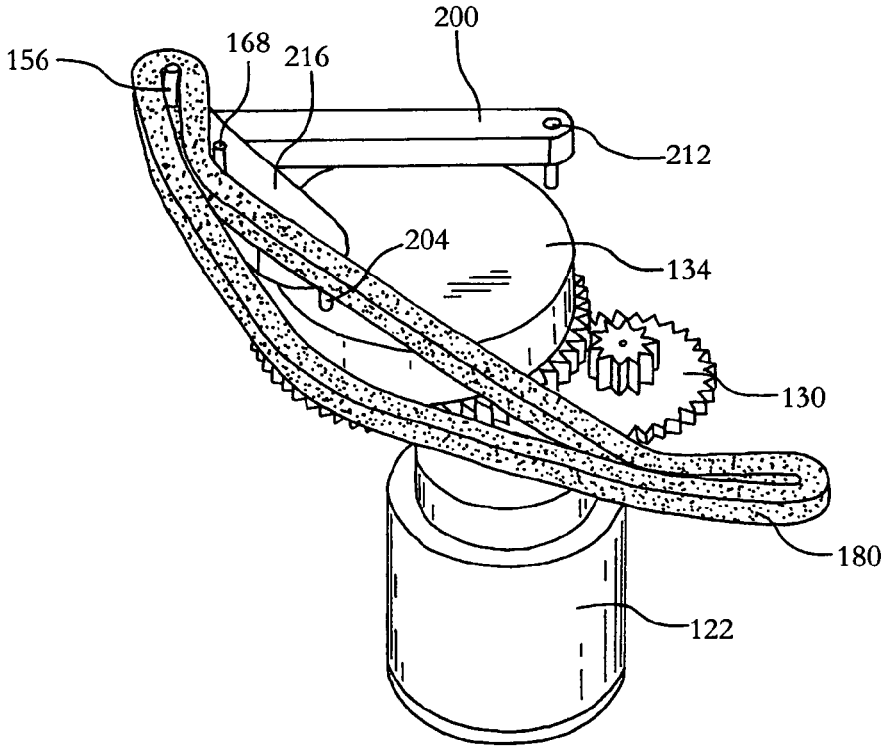
FIG. 2 is a isometric view of the preferred embodiment showing only a single drive and gearing assembly.

FIG. 2 illustrates in a detail view a single motor and drive system for the preferred embodiment. The portion shown is the upper right quadrant of the facial expression system.

Figure 3A:
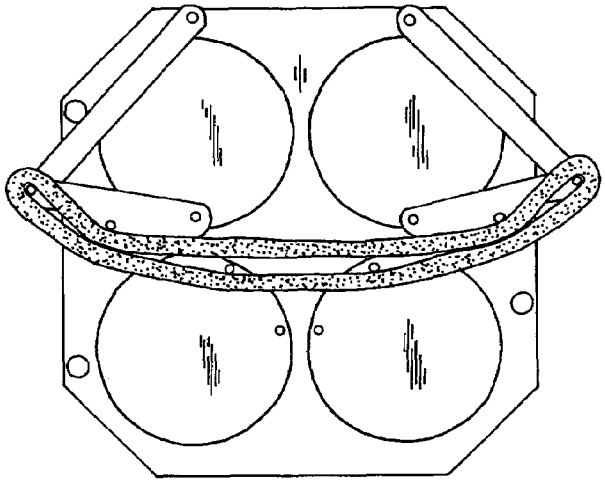
FIGS. 3*a*-3*f* are various top views showing the gear arrangement and relative position of the attachment points and inflection/deflection points to present the elastomeric material in a human-like expression.
Figure 3B:
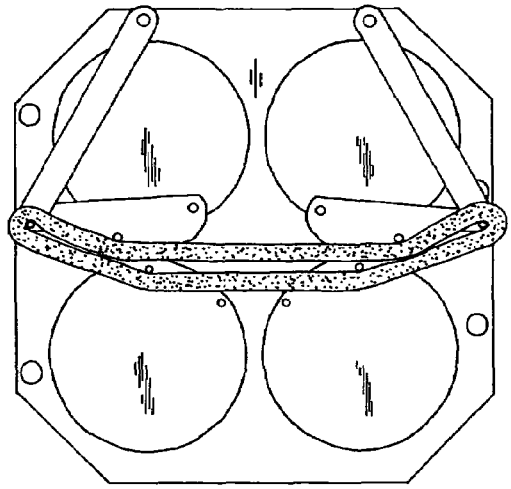
Figure 3C:
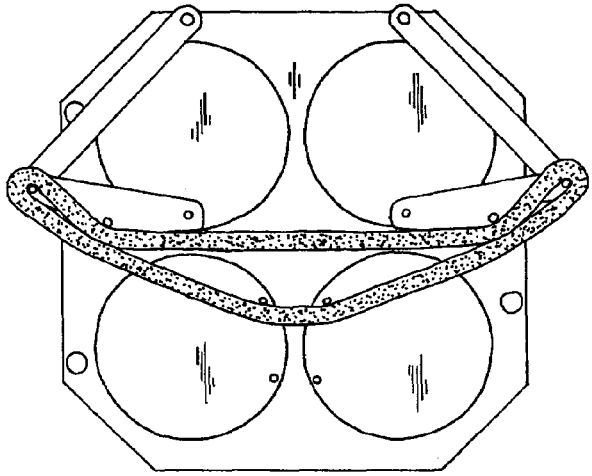
Figure 3D:
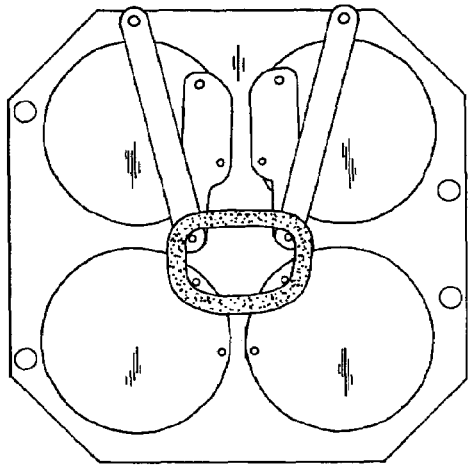
Figure 3E:
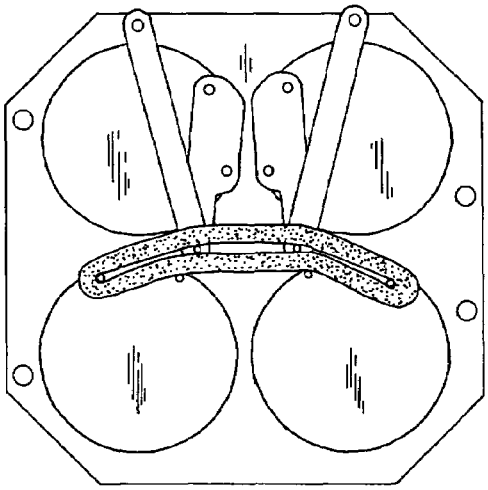
Figure 3F:
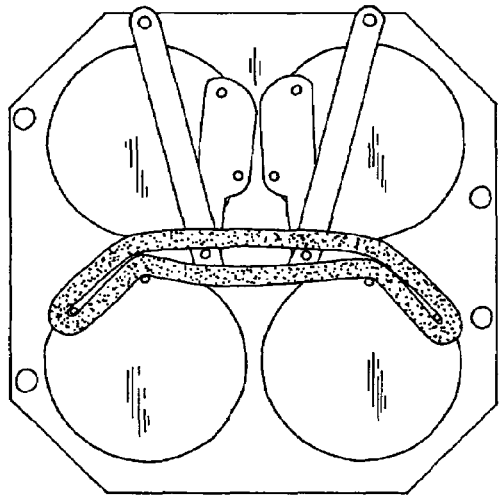

FIGS. 3*a*-3*f* illustrates examples of expression driving gear arrangements and their effect on the elastomeric material 180 stretched around the attachment points 156, 158, 160 and 162. FIG. 3*a*, FIG. 3*b* and FIG. 3*c* show arrangements approximating a smile. FIG. 3*d* shows the mechanism at rest. FIG. 3*e*-FIG. 3*f* shows arrangements emulating sadness and anger.

DETAILED DESCRIPTIONS OF ALTERNATE EMBODIMENTS

Referring to FIGS. 4*a*-4*e*, the mechanism 20, according to an alternate embodiment, comprises a lower motor support platform 319, an upper motor support platform 318 and a gear support platform 317. The motor support platform secures two motors 320 and 322, which in turn have small motor drive gears 324 and 326 respectively attached to their perspective drive shafts. Gears 324 and 326 mesh with reduction gears 328 and 330 respectively. The reduced diameters of reduction gears 328 and 330 mesh with primary expression driving gears 332 and 334 respectively. Positional sensing of the primary expression driving gear 332 is achieved by variable resistance or positional contacts on the control board 340. It is understood that other commercial means of encoding of position would be equally effective in positional sensing. Magnetic encoding, transmission slots counting, and reflective encoding are examples of other common methods of rotational encoding. Primary expression driving gears 332 and 334 in turn mesh with secondary expression driving gears 344 and 346 respectively. Each expression driving gear has two drive pins affixed to points in relation to the radius of each respective expression driving gear. Each gear's drive pins are at a fixed degree apart from one another. In the case of primary expression driving gear 332, it has attachment drive pin 360 and inflection-deflection drive pin 366 affixed. In the case of primary expression driving gear 344, it has attachment point 362 and inflection-deflection drive pin 364 affixed. In the case of primary expression driving gear 334, it has a link drive pin 404 and inflection-deflection drive pin 420 affixed. In the case of primary expression driving gear 346, it has a link drive pin 406 and inflection-deflection drive pin 422 affixed. Rotation of gears 334 and 346 cause link drive pins 404 and 406 to pivot links 400 and 402 as they travel through slots 408 and 410 respectively. Pivoting of links 400 and 402 on fulcrums 412 and 414 then cause inflection-deflection links 416 and 418 to be pulled outward or pushed inward guided by drive pins 420 and 422 respectively. Links 400 and 416 together form the first crank means. Links 402 and 418 together form the second crank means Affixed to links 400 and 402 are attachment points 356 and 358 which also serve as fulcrum points for inflection links 416 and 418 respectively. Affixed to links 416 and 418 are inflection-deflection points 368 and 370 respectively. Fitted around the four attachment points is elastomeric material 380. To prevent the return rotation of the primary and secondary expression driving gears, gearlocks 382 and 384 fits into the teeth of secondary expression driving gears 344 and 346 respectively. Gearlock 382 is allowed to release secondary expression driving gear 344 by having shaft 386 pulled by solenoid 390 and pivoted on its axis. Gearlock 384 is allowed to release secondary expression driving gear 346 by having shaft 388 pulled by solenoid 392 and pivoted on its axis.

Figure 4A:
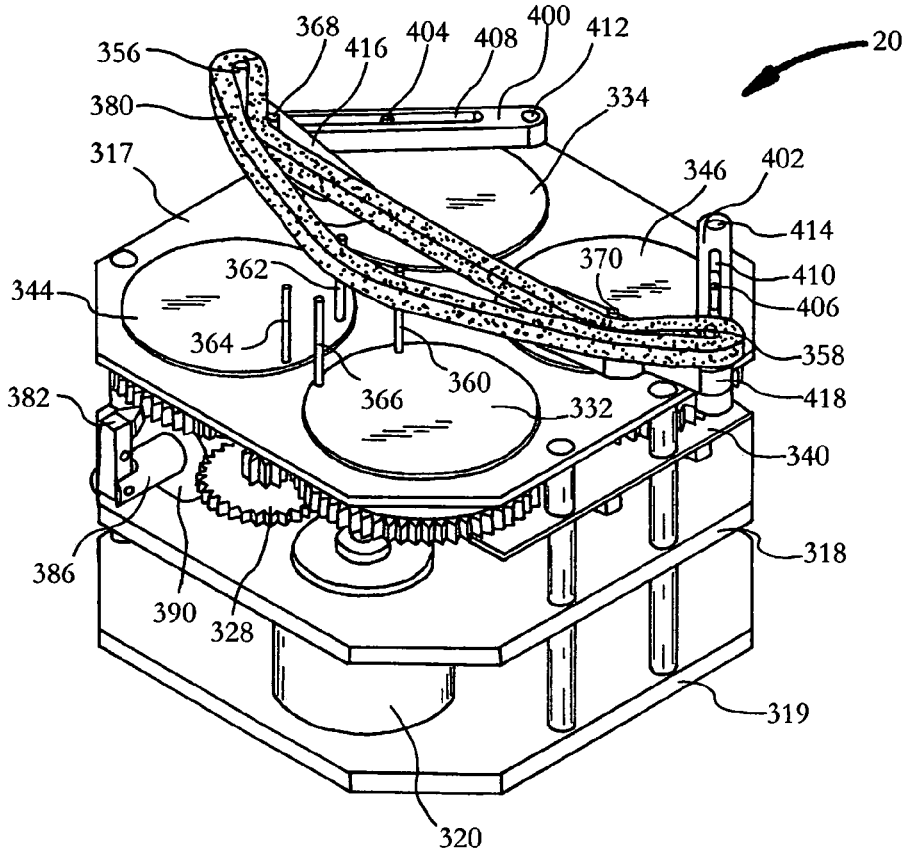
FIG. 4*a* is an isometric view showing a pair of dual gear, single drive mechanisms using motors with non-integrated encoding with the elastomeric material in place around attachment points on each of the gears and gear driven link mechanisms.

FIG. 4*a* is an isometric view of the alternate embodiment of the mechanism 20. In this view, the attachment points 356, 358, 360, and 362 for holding the elastomeric material 380 represent lips, in a smiling expression. In the alternate embodiment, power to the motors 320 and 322 (see also FIG. 4*b*) is not applied once the desired position is sensed by control board 340. Instead, position is maintained against the pull of elastomeric material 380 by securing drive gears 344 and 346 against rotation with the gearlocks 382 and 384 (see also FIG. 4*b*). Rotation of the motors and a change in expression of 20 as represented by the position of 380 is governed by the activation of solenoids 390 and 392, see also FIG. 4*b*, and the pull back of respective gearlocks 382 and 384.

Figure 4B:
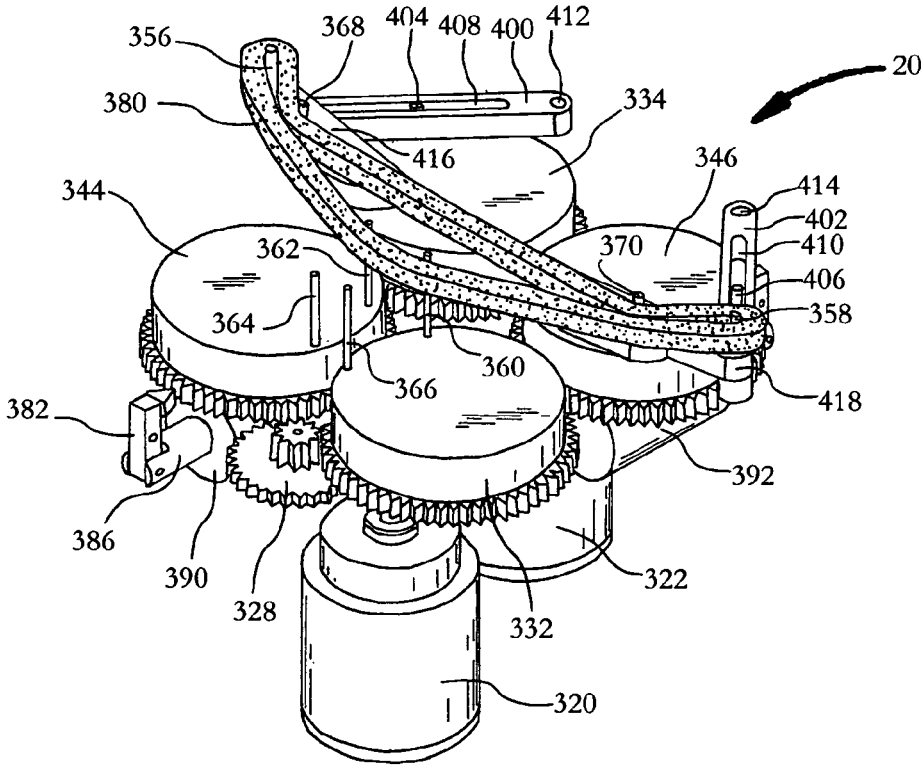
FIG. 4*b* is an isometric view with support platforms removed showing a pair of dual gear, single drive mechanisms employing motors with non-integrated encoding with the elastomeric material in place around attachment points on each of the gears and gear driven link mechanisms.

FIG. 4*b* shows the same isometric view of the alternate embodiment as FIG. 4*a* but with the removal of support platforms 317, 318, 319 and circuit board 340 for clarity, see also FIG. 4*a*.

Figure 4C:
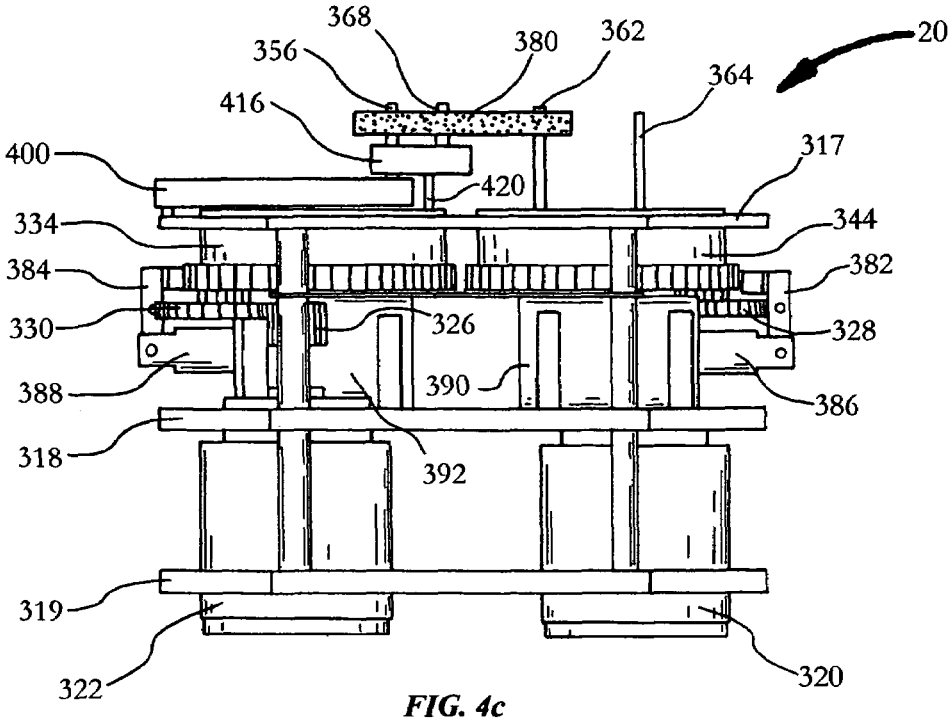
FIGS. 4*c*-4*e* are additional orthogonal views showing a pair of dual gear, single drive mechanisms using motors with non-integrated encoding with the elastomeric material in place around attachment points on each of the gears and gear driven link mechanisms.
Figure 4D:
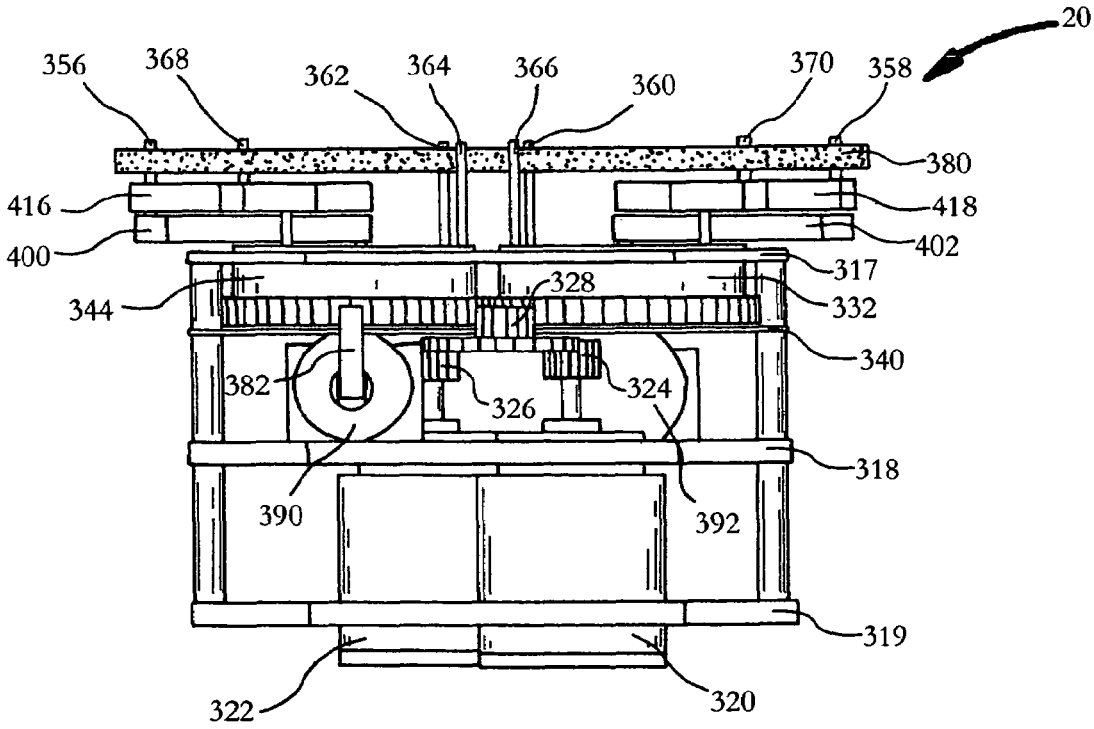

FIG. 4*c* and FIG. 4*d* also describe the alternate embodiment and show a right side and back view of the mechanism 20. These views give clear perspectives of the relative positions of reduction gears 328 and 330 to their meshed small motor drive gears 324 and 326 and primary expression driving gears 332 and 334.

Figure 4E:
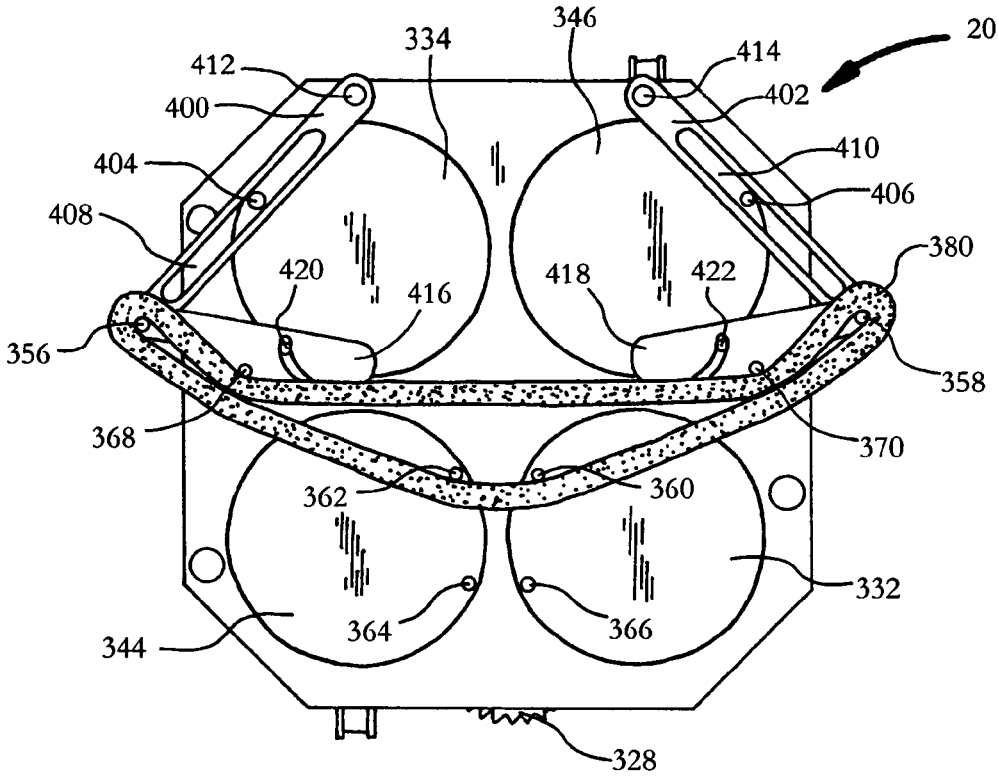

FIG. 4*e* describes the alternate embodiment and illustrates a top plan view of the mechanism 20. This view would be the side that faces forward and represents the mouth of an animated character or design.

Figure 5A:
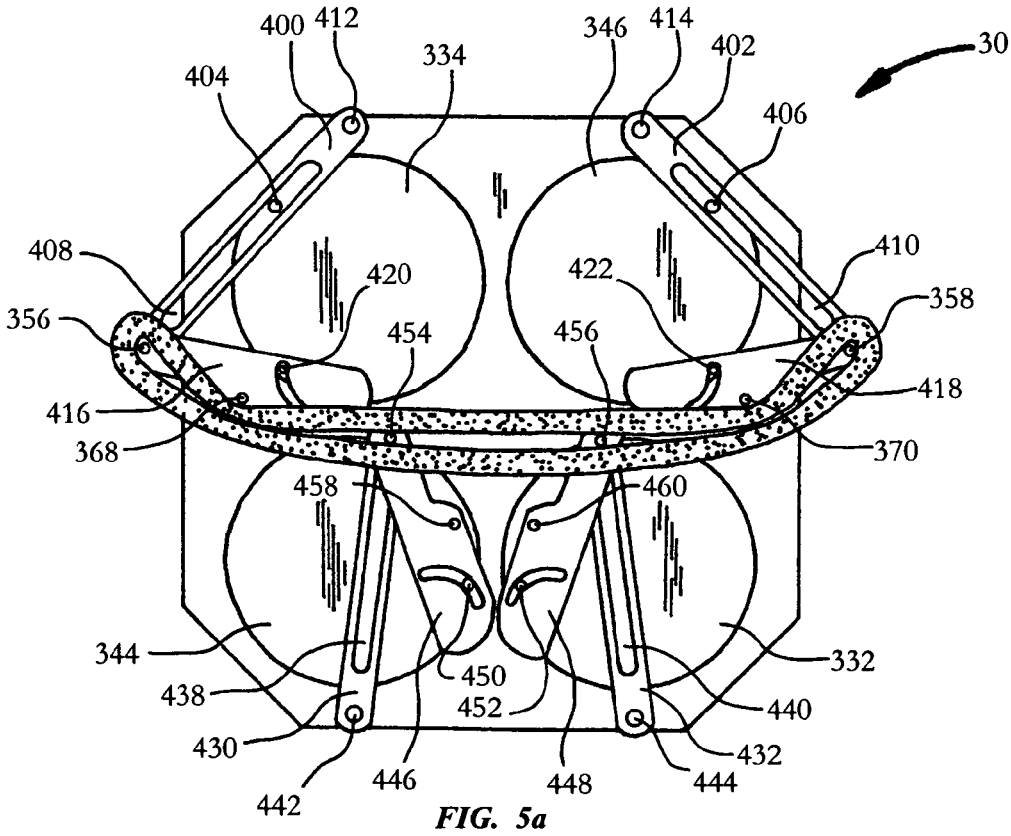
FIG. 5*a* is a top view showing a mechanism, utilizing slotted links on both the upper and lower portions of the mechanism.

FIG. 5*a* is a top plan view of an alternate embodiment of the mechanism 30. This view illustrates the side that faces forward and represents the mouth of an animated character or design.

Figure 5B:
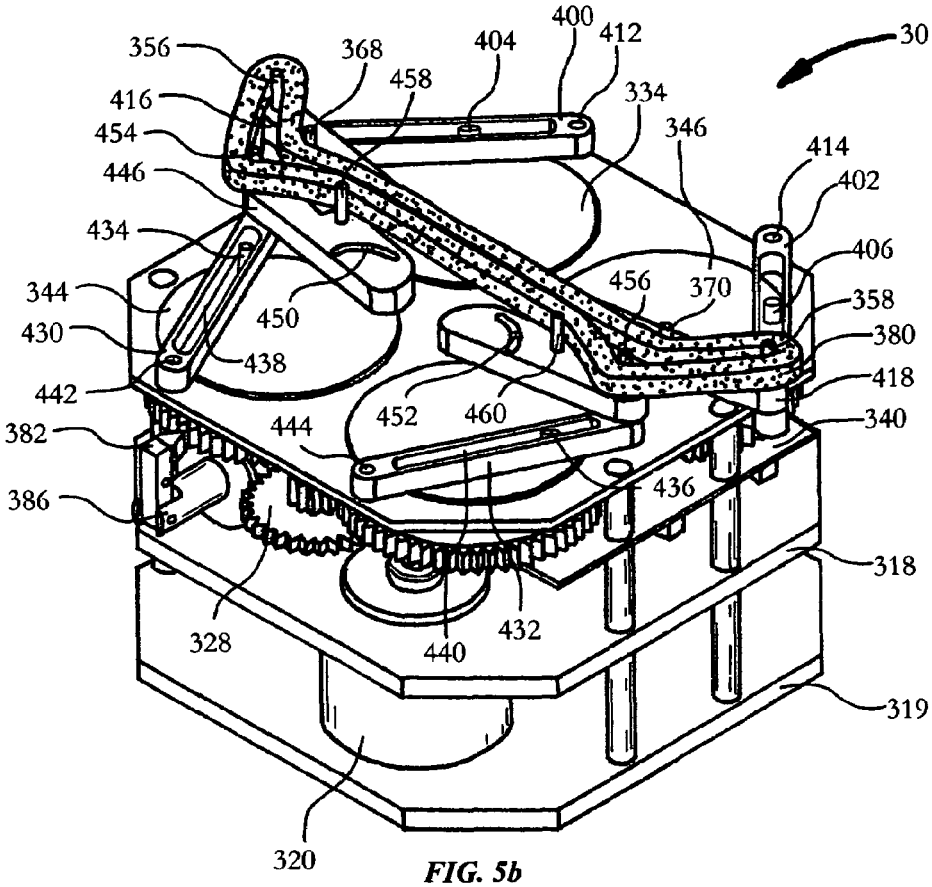
FIG. 5*b* is an isometric view showing a mechanism, utilizing slotted links on both the upper and lower portions of the mechanism.

FIG. 5*b* is an isometric view of an alternate embodiment of the mechanism 30. In this view, the attachment points 356, 358, 454, and 456 for holding the elastomeric material 380 represent lips, in a form suggestive of smiling expression.

FIGS. 5*a*-5*b* together provide top and isometric views respectively of a mechanism using pin and slot driven links on both the upper and lower gear pairs to enhance the motion of elastomeric material 380. The mechanism 30 is identical to the mechanism 20 with the exception of the four links and their associated drive pin locations and attached pins. By utilizing pin and slot driven links on both the upper and lower gear pairs a more comical expression can be achieved. In practice, this method has more novelty applications since the human frown is at a greater arc than a human smile. With this in mind, lower links would not be in the preferred embodiment but should be included as a method for other novelty devices and characters. Referring to FIGS. 5*a*-5*b*, the mechanism 30, according to this alternate embodiment, comprises a lower motor support platform 319, an upper motor support platform 318 and a gear support platform 317. The motor support platform secures two motors 320 and 322, which in turn have small motor drive gears 324 and 326 respectively attached to their perspective drive shafts. Gears 324 and 326 mesh with reduction gears 328 and 330 respectively. The reduced diameters of reduction gears 328 and 330 mesh with primary expression driving gears 332 and 334 respectively. Positional sensing of the primary expression driving gear 332 is achieved by variable resistance or positional contacts on the control board 340. It is understood that other commercial means of encoding of position would be equally effective in positional sensing. Magnetic encoding, transmission slots counting, and reflective encoding are examples of other common methods of rotational encoding. Primary expression driving gears 332 and 334 in turn mesh with secondary expression driving gears 344 and 346 respectively. Each expression driving gear has two drive pins affixed to points in relation to the radius of each respective expression driving gear. Each gear's drive pins are at a fixed degree apart from one another. In the case of primary expression driving gear 332, it has link drive pin 436 and inflection-deflection drive pin 452 affixed. In the case of primary expression driving gear 344, it has link drive pin 434 and inflection-deflection drive pin 450 affixed. In the case of primary expression driving gear 334, it has a link drive pin 404 and inflection-deflection drive pin 420 affixed. In the case of primary expression driving gear 446, it has a link drive pin 406 and inflection-deflection drive pin 422 affixed. Rotation of gears 334 and 346 cause link drive pins 404 and 406 to pivot links 400 and 402 as they travel through slots 408 and 410 respectively. Pivoting of links 400 and 402 on fulcrums 412 and 414 then cause inflection-deflection links 416 and 418 to be pulled outward or pushed inward guided by drive pins 420 and 422 respectively. Links 400 and 416 together form the first crank means. Links 402 and 418 together form the second crank means Affixed to links 400 and 402 are attachment points 356 and 358 which also serve as fulcrum points for inflection links 416 and 418 respectively. Affixed to links 416 and 418 are inflection-deflection points 368 and 370 respectively. Rotation of gears 332 and 344 cause link drive pins 434 and 436 to pivot links 430 and 432 as they travel through slots 438 and 440 respectively. Pivoting of links 430 and 432 on fulcrums 442 and 444 then cause inflection-deflection links 446 and 448 to be pulled outward or pushed inward guided by drive pins 450 and 452 respectively. Links 430 and 446 together form the third crank means. Links 432 and 448 together form the forth crank means Affixed to links 430 and 432 are attachment points 454 and 456 which also serve as fulcrum points for inflection links 446 and 448 respectively. Affixed to links 446 and 448 are inflection-deflection points 458 and 460 respectively. Fitted around the four attachment points is elastomeric material 380. To prevent the return rotation of the primary and secondary expression driving gears, gearlocks 382 and 384 fit into the teeth of secondary expression driving gears 344 and 346 respectively. Gearlock 382 is allowed to release secondary expression driving gear 344 by having shaft 386 pulled by solenoid 390 and pivoted on its axis. Gearlock 384 is allowed to release secondary expression driving gear 346 by having shaft 388 pulled by solenoid 392 and pivoted on its axis.

Figure 6A:
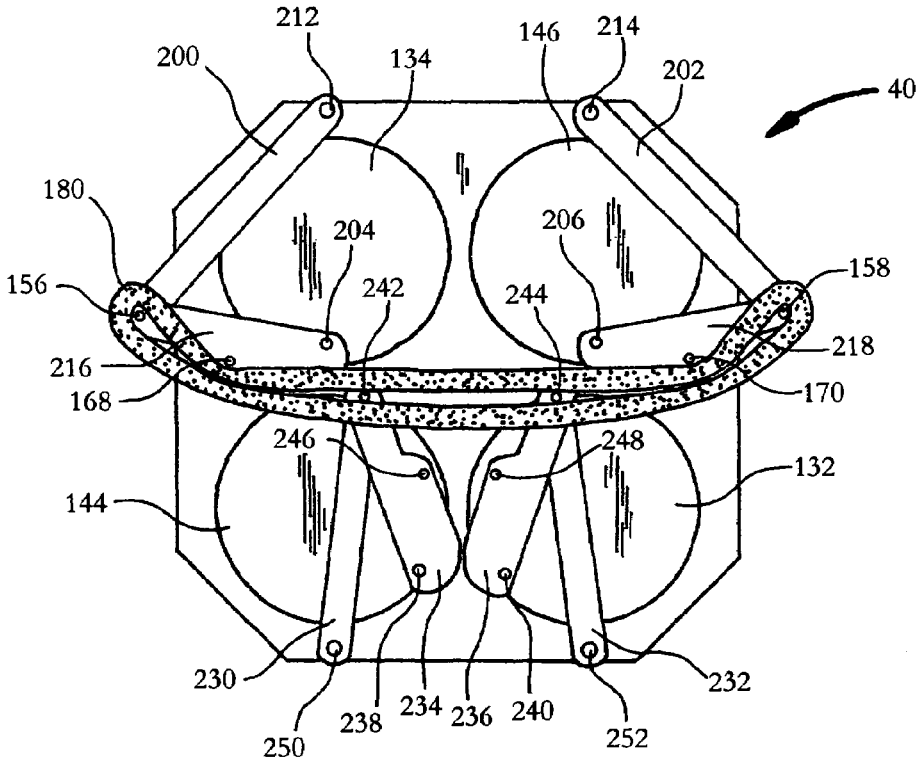
FIG. 6*a* is a top view showing a mechanism, utilizing slotted links on both the upper and lower portions of the mechanism.

FIG. 6*a* is a top plan view of an alternate embodiment of the mechanism 40. This view illustrates the side that faces forward and represents the mouth of an animated character or design.

Figure 6B:
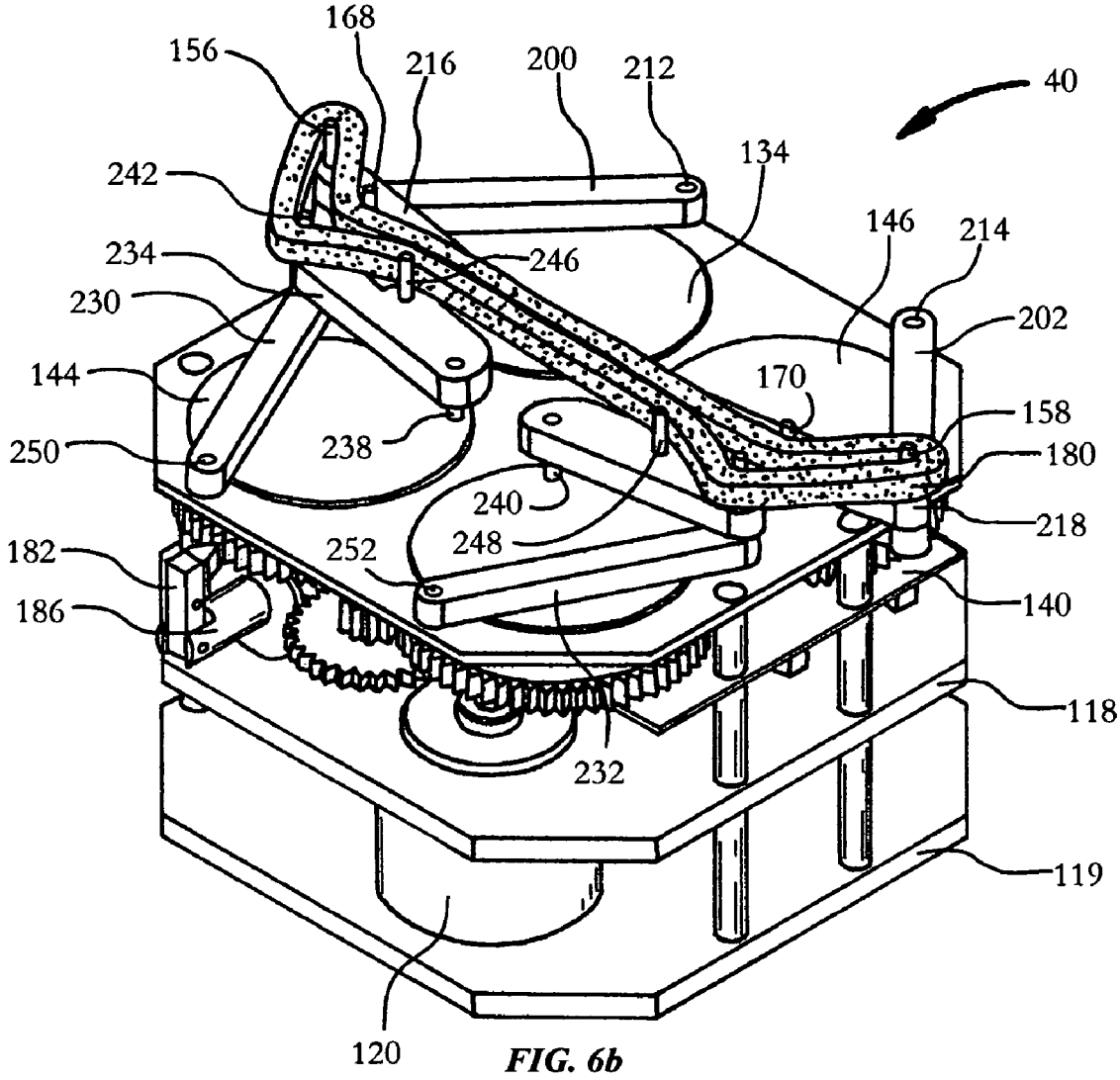
FIG. 6*b* is an isometric view showing a mechanism, utilizing links on both the upper and lower portions of the mechanism.

FIG. 6*b* is an isometric view of an alternate embodiment of the mechanism 40. In this view, pins 168, 170, 246 and 248 are contacting the outside of elastomeric material loop 180. The attachment points 156, 158, 242, and 244 are stretching from the inside of elastomeric material loop 180. The stretching and bending of the elastomeric material 180, representing lips, form an expression suggestive of a smirk.

FIGS. 6*a*-6*b* together provide top and isometric views respectively of a mechanism using links on both the upper and lower gear pairs to enhance the motion of elastomeric material 180. The mechanism 40 is identical to the mechanism 10 with the exception of the four links and their associated drive pin locations and attached pins. Referring to FIGS. 6*a*-6*b*, the mechanism 40, according to this alternate embodiment, comprises a lower motor support platform 119, an upper motor support platform 118 and a gear support platform 117. The motor support platform secures two motors 120 and 122, which in turn have small motor drive gears 124 and 126 respectively attached to their perspective drive shafts. Gears 124 and 126 mesh with reduction gears 128 and 130 respectively. The reduced diameters of reduction gears 128 and 130 mesh with primary expression driving gears 132 and 134 respectively. Positional sensing of the primary expression driving gear 132 is achieved by variable resistance or positional contacts on the control board 140. It is understood that other commercial means of encoding of position would be equally effective in positional sensing. Magnetic encoding, transmission slots counting, and reflective encoding are examples of other common methods of rotational encoding. Primary expression driving gears 132 and 134 in turn mesh with secondary expression driving gears 144 and 146 respectively. Each expression driving gear has a single drive pin affixed. In the case of primary expression driving gear 132, it has link drive pin 240 affixed. In the case of primary expression driving gear 144, it has link drive pin 238 affixed. In the case of primary expression driving gear 134, it has a link drive pin 204 affixed. In the case of primary expression driving gear 146, it has a link drive pin 206 affixed. Rotation of gears 134 and 146 causes link drive pins 204 and 206 to push or pull inflection-deflection links 216 and 218. The pushing or pulling of inflection-deflection links 216 and 218 in turn causes the pivoting of links 200 and 202 on fulcrums 212 and 214 respectively. Links 200 and 216 together form the first crank means. Links 202 and 218 together form the second crank means Rotation of gears 144 and 132 causes link drive pins 238 and 240 to push or pull inflection-deflection links 234 and 236 respectively. The pushing or pulling of inflection-deflection links 234 and 236 in turn causes the pivoting of links 230 and 232 on fulcrums 250 and 252 respectively. Links 230 and 234 together form the third crank means. Links 232 and 236 together form the forth crank means Affixed to links 200 and 204 are attachment points 156 and 158 which also serve as fulcrum points for inflection links 216 and 218 respectively. Affixed to links 216 and 218 are inflection-deflection points 168 and 170 respectively. Affixed to links 230 and 232 are attachment points 242 and 244 which also serve as fulcrum points for inflection links 234 and 236 respectively. Affixed to links 234 and 236 are inflection-deflection points 246 and 248 respectively. Fitted around the four attachment points is elastomeric material 180. To prevent the return rotation of the primary and secondary expression driving gears, gearlocks 182 and 184 fit into the teeth of secondary expression driving gears 144 and 146 respectively. Gearlock 182 is allowed to release secondary expression driving gear 144 by having shaft 186 pulled by solenoid 190 and pivoted on its axis. Gearlock 184 is allowed to release secondary expression driving gear 146 by having shaft 188 pulled by solenoid 192 and pivoted on its axis.

Figure 7A:
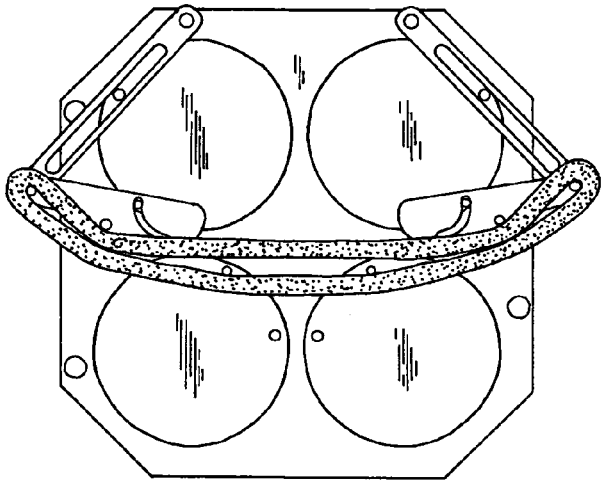
FIGS. 7*a*-7*f* are various top plan views showing the gear arrangement and relative position of the attachment points and inflection/deflection points to present the elastomeric material in an expression.
Figure 7B:
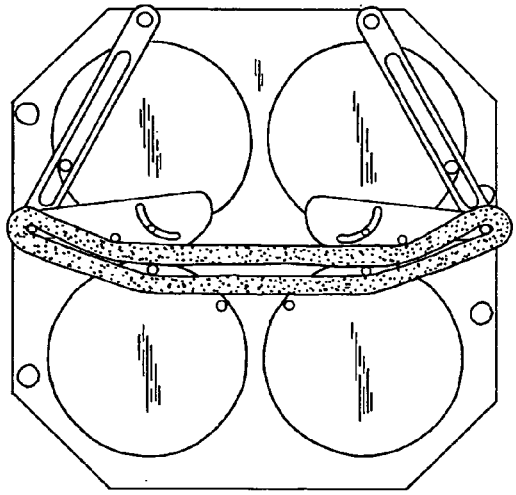
Figure 7C:
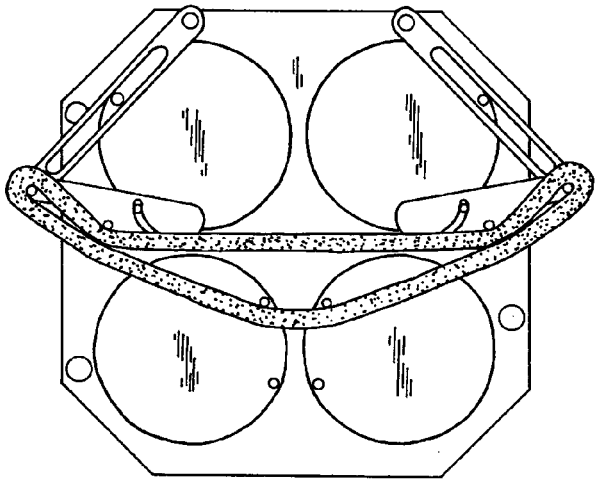
Figure 7D:
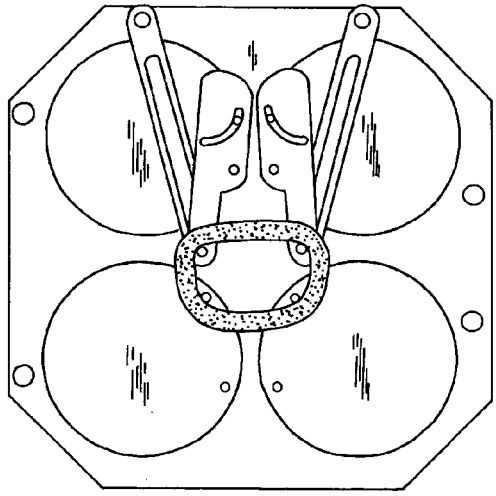
Figure 7E:
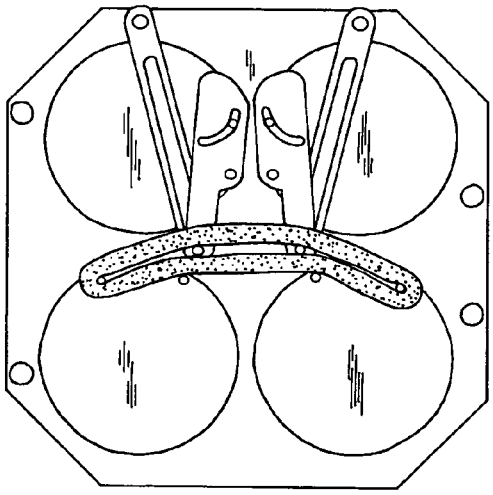
Figure 7F:
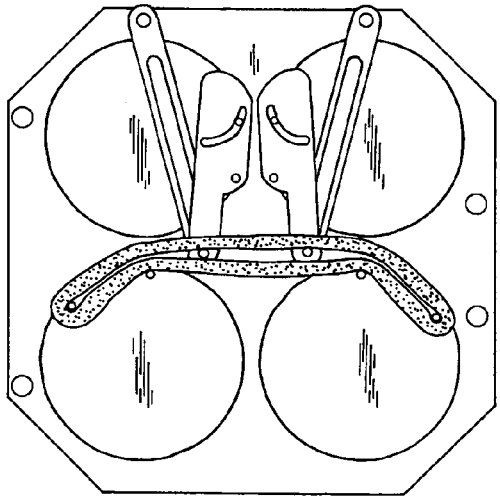

FIGS. 7*a*-7*f* illustrate examples of expression driving gear arrangements for mechanism 20 and their effect on the elastomeric material stretched around the attachment points. FIG. 7*a*, FIG. 7*b* and FIG. 7*c* show arrangements approximating a smile. FIG. 7*d* shows the mechanism at rest. FIG. 7*e*-FIG. 7*f* shows arrangements emulating sadness and anger.

While the invention has been described with reference to the preferred embodiment thereof it will be appreciated by those of ordinary skill in the art that modifications can be made to the parts that comprise the invention without departing from the spirit and scope thereof.

I claim:

1. An apparatus for mimicking human-like expressions comprising:

a platform;

a first rotatable means connected to said platform and having a first drive pin means thereon;

a first link having a first end and a second end and wherein said first end is pivotally connected to said platform, said second end of said first link having a first attachment pin thereon;

a second link also having a first and second end and wherein said first end is pivotally connected to said first rotatable means and said second end is connected to said attachment pin on said first link wherein said second link is driven by said first drive pin means;

a second rotatable means connected to said platform and having a second drive pin means thereon;

a third link having a first end and a second end and wherein said first end is pivotally connected to said platform, said second end of said third link having a second attachment pin thereon;

a fourth link also having a first and second end and wherein said first end is pivotally connected to said second rotatable means and said second end is connected to said second attachment pin on said third link wherein said fourth link is driven by said second drive pin means;

an elastic loop means having an inside and an outside and wherein said first and second attachment pins are located on the inside of said elastic loop means; and, a drive means for driving at least one of said rotatable means, wherein said first and second rotatable means rotate in opposite directions and wherein said first and second rotatable means drive said second and fourth links and cause said elastic means to assume forms suggestive of human expression.

2. The apparatus of claim 1 further comprising:

a first deflection pin means attached to said second link for contacting the outside of said elastic means and changing the shape of said elastic means as said first and second rotatable means rotate.

3. The apparatus of claim 2 further comprising:

a second deflection pin means attached to said fourth link for contacting the outside of said elastic means and changing the shape of said elastic means as said first and second rotatable means rotate.

4. The apparatus of claim 3 further comprising:

a third rotatable means connected to said platform and having a third attachment pin thereon; and, a fourth rotatable means also connected to said platform and having a fourth attachment pin located thereon, wherein said third and fourth attachment pins are located in the inside of said elastic means and further wherein at least one of said third and fourth rotatable means are driven by said drive means.

5. The apparatus of claim 4 further comprising:

a third deflection pin means attached to said third rotatable means; and, a fourth deflection pin means attached to said fourth rotatable means, wherein said third and fourth deflection pin means selectively contact the outside of said elastic means and change the shape of said elastic means as said third and fourth rotatable means rotate.

6. An apparatus for mimicking human-like expressions comprising:

a platform;

a first rotatable means mounted on said platform;

a first crank means having a first end and a second end, wherein said first end is pivotally connected to said platform and said second end is pivotally connected to said first rotatable means, said first crank means further including a first attachment pin thereon and wherein said first crank means is driven by said first rotatable means;

a second rotatable means also mounted on said platform;

a second crank means having a first end and a second end, wherein said first end is pivotally connected to said platform and said second end is pivotally connected to said second rotatable means, said second crank means further including a second attachment pin thereon and wherein said second crank means is driven by said second rotatable means;

an elastic loop means having an inside and an outside and wherein said first and second attachment pins are located on the inside of said elastic loop means; and, a drive means for driving at least one of said rotatable means, wherein said first and second rotatable means rotate in opposite directions and wherein said first and second rotatable means drive said first and second crank means and cause said elastic means to assume forms suggestive of human expression.

7. The apparatus of claim 6 wherein said first crank means comprises a first link and a second link and wherein said first link is pivotally connected to said platform at one end and said second link is pivotally connected to said first rotatable means and said first and second links are also connected to each other at said first attachment pin.

8. The apparatus of claim 7 wherein said second crank means comprises a third link and a fourth link and wherein said third link is pivotally connected to said platform at one end and said fourth link is pivotally connected to said second rotatable means and said third and fourth links are also connected to each other at said second attachment pin.

9. The apparatus of claim 8 further comprising:

a first deflection pin means attached to said second link for contacting the outside of said elastic means and changing the shape of said elastic means as said first and second rotatable means rotate.

10. The apparatus of claim 9 further comprising:

a second deflection pin means attached to said fourth link for contacting the outside of said elastic means and changing the shape of said elastic means as said first and second rotatable means rotate.

11. The apparatus of claim 10 further comprising:

a third rotatable means connected to said platform and having a third attachment pin thereon; and, a fourth rotatable means also connected to said platform and having a fourth attachment pin located thereon, wherein said third and fourth attachment pins are located in the inside of said elastic means and further wherein at least one of said third and fourth rotatable means are driven by said drive means.

12. The apparatus of claim 11 further comprising:

a third deflection pin means attached to said third rotatable means; and, a fourth deflection pin means attached to said fourth rotatable means, wherein said third and fourth deflection pin means selectively contact the outside of said elastic means and change the shape of said elastic means as said third and fourth rotatable means rotate.

13. The apparatus of claim 6 further comprising:

a third rotatable means mounted on said platform;

a third crank means having a first end and a second end, wherein said first end is pivotally connected to said platform and said second end is pivotally connected to said third rotatable means, said third crank means further including a third attachment pin thereon and wherein said third crank means is driven by said third rotatable means;

a fourth rotatable means also mounted on said platform;

a fourth crank means having a first end and a second end, wherein said first end is pivotally connected to said platform and said second end is pivotally connected to said fourth rotatable means, said fourth crank means further including a fourth attachment pin thereon and wherein said fourth crank means is driven by said fourth rotatable means;

said elastic loop means having an inside and an outside and further wherein said third and fourth attachment pins are located on the inside of said elastic loop means; and, a drive means for driving at least one of said rotatable means, wherein said third and fourth rotatable means rotate in opposite directions and wherein said third and fourth rotatable means drive said third and fourth crank means and cause said elastic means to assume forms suggestive of human expression.

14. The apparatus of claim 13 wherein said third crank means comprises a fifth link and a sixth link and wherein said fifth link is pivotally connected to said platform at one end and said sixth link is pivotally connected to said third rotatable means and said fifth and sixth links are also connected to each other at said third attachment pin.

15. The apparatus of claim 14 wherein said fourth crank means comprises a seventh link and a eighth link and wherein said seventh link is pivotally connected to said platform at one end and said eighth link is pivotally connected to said fourth rotatable means and said seventh and eighth links are also connected to each other at said fourth attachment pin.

16. The apparatus of claim 15 further comprising:

a third deflection pin means attached to said sixth link for contacting the outside of said elastic means and changing the shape of said elastic means as said third and fourth rotatable means rotate.

17. The apparatus of claim 16 further comprising:

a fourth deflection pin means attached to said eighth link for contacting the outside of said elastic means and changing the shape of said elastic means as said third and fourth rotatable means rotate.

18. An apparatus for mimicking human-like expressions comprising:

a platform;

a first rotatable means connected to said platform and having a first drive pin means thereon;

a first crank means connected to said platform, said first crank means having a first attachment pin thereon and wherein said first crank means is driven by said first drive pin means;

a second rotatable means also connected to said platform and having a second drive pin means thereon;

a second crank means also connected to said platform, said second crank means having a second attachment pin thereon and wherein said second crank means is driven by said second drive pin means;

an elastic means attachable to said first and second attachment pins on said first and second crank means and wherein the plain of said elastic means is substantially parallel to the plain of rotation of said first and second rotatable means; and, a drive means for driving at least one of said rotatable means, wherein said first and second rotatable means rotate in opposite directions and wherein said first and second rotatable means cause said elastic means to assume forms suggestive of human expression.

19. The apparatus of claim 18 wherein said first drive pin means on said first rotatable means comprises a first and second drive pin.

20. The apparatus of claim 19 wherein said first crank means comprises:

a first link pivotally connected to said platform and wherein said first link is driven by said first drive pin: and, a second link pivotally connected to said first rotatable means and wherein said second link is driven by said second drive pin.

21. The apparatus of claim 20 wherein said elastic means has an inside and an outside and wherein said first and second attachment pins are located on the inside of said elastic means.

22. The apparatus of claim 21 further comprising a first deflection pin means attached to said second link for contacting the outside of said elastic means and changing the shape of said elastic means as said first and second rotatable means rotate.

23. The apparatus of claim 22 wherein said second drive pin means on said second rotatable means comprises a third and fourth drive pin.

24. The apparatus of claim 23 wherein said second crank means comprises:

a third link pivotally connected to said platform and wherein said third link is driven by said third drive pin: and, a fourth link pivotally connected to said second rotatable means and wherein said fourth link is driven by said fourth drive pin.

25. The apparatus of claim 24 further comprising a second deflection pin means attached to said fourth link for contacting the outside of said elastic means and changing the shape of said elastic means as said first and second rotatable means rotate.

26. The apparatus of claim 25 wherein said first, second, third and fourth links include first, second, third and fourth drive pin engaging slots therein respectively and wherein said first, second, third and fourth drive pins are engagable in said first, second, third and fourth slots respectively.

27. The apparatus of claim 25 wherein said third crank means comprises:

a fifth link pivotally connected to said platform and wherein said fifth link is driven by said fifth drive pin: and, a sixth link also pivotally connected to said third rotatable means and wherein said sixth link is driven by said sixth drive pin.

28. The apparatus of claim 27 wherein said elastic means has an inside and an outside and wherein said third and fourth attachment pins are located on the inside of said elastic means.

29. The apparatus of claim 28 further comprising a third deflection pin means attached to said sixth link for contacting the outside of said elastic means and changing the shape of said elastic means as said third and fourth rotatable means rotate.

30. The apparatus of claim 29 wherein said fourth drive pin means on said fourth rotatable means comprises a seventh drive pin and eighth drive pin.

31. The apparatus of claim 30 wherein said fourth crank means comprises:

a seventh link pivotally connected to said platform and wherein said seventh link is driven by said seventh drive pin: and, an eighth link pivotally connected to said fourth rotatable means and wherein said eighth link is driven by said eighth drive pin.

32. The apparatus of claim 31 further comprising a fourth deflection pin means attached to said eighth link for contacting the outside of said elastic means and changing the shape of said elastic means as said third and fourth rotatable means rotate.

33. The apparatus of claim 25 wherein said fifth, sixth, seventh and eighth links include fifth, sixth, seventh and eighth drive pin engaging slots therein respectively and wherein said fifth, sixth, seventh and eighth drive pins are engagable in said fifth, sixth, seventh and eighth slots respectively.

34. The apparatus of claim 18 further comprising:

a third rotatable means connected to said platform and having a third attachment pin thereon; and, a fourth rotatable means also connected to said platform and having a fourth attachment pin located thereon, wherein said third and fourth attachment pins are located in the inside of said elastic means and further wherein at least one of said third and fourth rotatable means are driven by said drive means.

35. The apparatus of claim 34 further comprising:

a third deflection pin means attached to said third rotatable means; and, a fourth deflection pin means attached to said fourth rotatable means, wherein said third and fourth deflection pin means selectively contact the outside of said elastic means and change the shape of said elastic means as said third and fourth rotatable means rotate.

36. The apparatus of claim 18 further comprising:

a third rotatable means connected to said platform and having a third drive pin means thereon;

a third crank means connected to said platform, said third crank means having a third attachment pin thereon and wherein said third crank means is driven by said third drive pin means;

a fourth rotatable means also connected to said platform and having a fourth drive pin means thereon;

a fourth crank means also connected to said platform, said fourth crank means having a fourth attachment pin thereon and wherein said fourth crank means is driven by said fourth drive pin means.

37. The apparatus of claim 36 wherein said third drive pin means on said third rotatable means comprises a fifth drive pin and sixth drive pin.

38. An apparatus for mimicking human-like expressions comprising:

a platform;

a first rotatable means connected to said platform and having a first drive pin means thereon;

a first crank means connected to said platform, said first crank means having a first attachment pin thereon and wherein said first crank means is driven by said first drive pin means;

a second rotatable means also connected to said platform and having a second drive pin means thereon;

a second crank means also connected to said platform, said second crank means having a second attachment pin thereon and wherein said second crank means is driven by said second drive pin means;

an elastic loop means having an inside and an outside and wherein said first and second attachment pins are located on the inside of said elastic loop means; and, a drive means for driving at least one of said rotatable means, wherein said first and second rotatable means rotate in opposite directions and wherein said first and second rotatable means drive said first and second crank means and cause said elastic means to assume forms suggestive of human expression.

* * * * *